US007927187B2

(12) United States Patent
Watanabe et al.

(10) Patent No.: US 7,927,187 B2
(45) Date of Patent: Apr. 19, 2011

(54) METHOD OF POLISHING A TARGET SURFACE

(75) Inventors: Jun Watanabe, Akishima (JP); Tetsujiro Tada, Akishima (JP); Takashi Arahata, Akishima (JP); Jun Tamura, Akishima (JP); Moriaki Akazawa, Tokyo (JP); Masaru Sakamoto, Itami (JP); Takahiko Kawasaki, Tokyo (JP)

(73) Assignee: NIHON Micro Coating Co., Ltd., Tokyo (JP)

( * ) Notice: Subject to any disclaimer, the term of this patent is extended or adjusted under 35 U.S.C. 154(b) by 163 days.

(21) Appl. No.: 12/126,383

(22) Filed: May 23, 2008

(65) Prior Publication Data

US 2008/0293332 A1 Nov. 27, 2008

(30) Foreign Application Priority Data

May 25, 2007 (JP) ..... 2007-138613

(51) Int. Cl.
*B24B 7/22* (2006.01)

(52) U.S. Cl. ..... 451/41; 451/527

(58) Field of Classification Search ..... 451/526, 451/527, 530, 550, 41
See application file for complete search history.

(56) References Cited

U.S. PATENT DOCUMENTS

| | | | | |
|---|---|---|---|---|
| 6,135,856 | A * | 10/2000 | Tjaden et al. | 451/37 |
| 7,544,115 | B2 * | 6/2009 | O'Moore | 451/64 |
| 2004/0014413 | A1 * | 1/2004 | Kawahashi et al. | 451/527 |
| 2006/0217049 | A1 * | 9/2006 | Li et al. | 451/533 |
| 2006/0270325 | A1 * | 11/2006 | Choi | 451/285 |

* cited by examiner

*Primary Examiner* — Robert Rose
(74) *Attorney, Agent, or Firm* — Weaver Austin Villeneuve & Sampson LLP

(57) ABSTRACT

A circular polishing pad has grooves formed on the surface in a spiral pattern with its center point offset from the center of the pad. The spiral pattern is an Archimedean spiral pattern or a parabolic spiral pattern. A target object is polished by using such a polishing pad without oscillating the platen to which the polishing pad is pasted or the polishing head that holds the target object.

8 Claims, 7 Drawing Sheets

| | Offset of spiral (mm) | | | | | Offset of concentric circles (mm) | | | | |
|---|---|---|---|---|---|---|---|---|---|---|
| | 0 (Example1) | 5 (Example 2) | 15 (Example 3) | 30 (Example 4) | 35 (Example 5) | 0 (Example 6) | 5 | 15 (Example 7) | 30 | 35 |
| Waviness at center part of waver | C | A | A | A | A | C | - | B | - | - |
| Uniformity of wafer as a whole | A | A | A | A | C | | - | A | - | - |

*FIG. 8*

METHOD OF POLISHING A TARGET SURFACE

This application claims priority on Japanese Patent Application 2007-138613 filed May 25, 2007.

BACKGROUND OF THE INVENTION

This invention relates to a polishing method usable for polishing the surface of a target object such as a semiconductor device wafer, a magnetic hard disk or its substrate (such as an aluminum substrate and a glass substrate), and an optical component such as a glass lens, a prism and a reflective mirror that requires a high level of flatness on the surface. In particular, this invention relates to a method of polishing for the planarization of the surface of a thin film such as an oxide film and a metallic film formed on a wafer during the production of a semiconductor device.

The surface of an object, such as a semiconductor device wafer, a magnetic hard disk or its substrate (such as an aluminum substrate and a glass substrate), and an optical component such as a glass lens, a prism and a reflective mirror that requires a high level of flatness on the surface, is usually mirror-polished by using slurry having abrading particles dispersed within a liquid, while there are situations where this kind of polishing process is carried out after a rough polishing process referred to as the lapping process.

In the above and throughout herein, the polishing shall broadly mean the process of pressing the target object to be polished onto a polishing means or the polishing means onto the target object and rubbing them together one against the other. Both the mirror-polishing process and the lapping process mentioned above are considered a kind of the polishing process thus broadly defined.

The types of polishing include both the fixed particle polishing and the free particle polishing.

The fixed particle polishing is a process by using polishing means having abrading particles dispersed and fixed in a synthetic resin material and is an effective method exhibiting high fabrication efficiency against materials that are hard to fabricate. The fixed particle polishing is generally used in the lapping process as a preliminary process prior to the polishing.

Porous polishing pads having abrading particles dispersed and fixed are included in the polishing means having abrading particles fixed in a synthetic resin material.

Examples of such porous polishing pad include, for example, those having abrading particles dispersed and fixed in a woven or unwoven sheet and those having abrading particles dispersed and fixed in a planar material comprising a foamed substance (or a foamed sheet).

Examples of polishing means having abrading particles fixed in a synthetic resin material as described above also include polishing pads having abrading particles dispersed and fixed in a planar material of a non-foamed material (or a planar uniform, solid material of a synthetic resin) (or a non-foamed sheet).

In a fixed particle polishing process, a polishing liquid is caused to be present between the target object and the polishing means when the surface of the target object is polished, and examples of such polishing liquid include slurry having abrading particles dispersed within a liquid, a cooling or lubricating liquid not containing abrading particles, liquids containing an agent that reacts chemically with the surface of the target object, and slurry having abrading particles dispersed in such a liquid.

The free particle polishing is a process whereby a polishing liquid containing abrading particles is caused to be present between the target object and the polishing means for polishing the surface of the target object. This process is generally used as the finishing process, and examples of polishing liquid containing abrading particles include slurry having abrading particles dispersed within liquid and such slurry having added thereto an agent that reacts chemically with the surface of the target object.

A porous polishing pad not having abrading particles fixed is used as the polishing means, and example of such porous polishing pad include woven and non-woven sheets and foamed pads. Examples of polishing means usable in a free particle polishing process further include non-foamed pads such as polishing pads comprising a uniform and solid planar material made of a synthetic resin.

The surface of a target object requiring a high level of flatness (such as semiconductor device wafers) is thus polished by a free particle polishing process.

Next, the polishing of the surface of a semiconductor device wafer, or its planarization, will be explained.

Conventionally, the surface planarization of a semiconductor device wafer (hereinafter referred to simply as the "wafer") has been carried out by using a polishing device of the oscillating polishing head type (shown at 30' in FIG. 1A) or of the oscillating platen type (not shown).

The polishing device 30' shown in FIG. 1A is comprised of a platen P having a circular flat surface, a polishing head C for holding a wafer W and pressing the surface of this wafer W onto the surface of a porous or non-foamed circular polishing pad 20 pasted onto the surface of the platen P, an oscillating mechanism (not shown) for causing the polishing head C to undergo an oscillatory motion in the radial directions shown by arrows T of the platen P, and a nozzle N for supplying a polishing liquid containing abrading particles onto the surface of the polishing pad.

The polishing pad 20 is pasted onto the surface of the platen P such that its center point 21 will fall upon the center of rotation 31 of the platen P, while the platen P is adapted to rotate in the direction of arrow R around its center of rotation 31 by the operation of its driving mechanism (not shown) connected to the platen P.

As described in Japanese Patent Publication 2006-250205, the wafer W is kept so as to match the center of rotation of the polishing head C within an annular retainer ring provided on the lower surface of the polishing head C and rotates in the direction of arrow r around the center of the wafer W, or the center of its rotation 32 by the operation of its driving mechanism (not shown) connected to the polishing head C.

In order to make uniform within its surface the relative speed (with respect to the polishing pad 20) of the wafer W pressed against the polishing pad 20, the platen P and the wafer W are rotated in the same direction (as shown by arrows R and r).

A circular foamed or non-foamed member or a non-foamed pad with abrading particles not fixed is usually used as the polishing pad 20 pasted to the surface of the platen P, and, as shown in FIG. 4, grooves 22 are formed in the form of concentric circles around the center 21 of the polishing pad 20 passing through the center of rotation 31 of the platen P on the surface of the polishing pad 20 for stabilizing the flow of the polishing liquid supplied to the surface of the polishing pad 20. As described in Japanese Patent Publications 2004-140130 and 2006-068853, for example, lattice-shaped grooves 13*b* as shown in FIG. 3A and dot-like holes 13*a* as shown in FIG. 3B may also be formed on the surface of the polishing pad 20.

In the case of a polishing pad with grooves thus formed on its surface, if the grooves are formed in a regular pattern, effects of this pattern appear on the surface of the wafer W as polishing marks. In order to reduce these effects of the groove pattern, it has been a common practice to cause the polishing head C or the platen P to undergo a reciprocating motion in radial directions of the platen P as shown by arrows T, as described, for example, in Japanese Patent Publication 2006-068853. This reciprocating motion is generally referred to as oscillation. In the illustrated example, it is the polishing head C that is being oscillated in the directions of arrows T. The width of this oscillation is generally set within one pitch of the groove pattern formed on the polishing pad, and the oscillatory motion is usually carried out with frequency in the range of about 0.01 Hz-0.04 Hz and the waveform controlled sinusoidally or trapezoidally.

This is the way the surfaces of semiconductor device wafers are being polished, but the surfaces of target objects of other kinds described above (such as magnetic hard disks and their substrates) are also being polished by using a polishing device of the oscillating polishing head type or of the oscillating platen type, as described above, that is, by moving the polishing head or the platen oscillatingly during the polishing process.

SUMMARY OF THE INVENTION

If a polishing pad with a groove pattern is used, as described above, effects of this groove pattern appear on the surface of the target object as small waviness. Although the polishing head or the platen is oscillated during the polishing process in order to reduce this effect, if the polishing head or the platen is thus oscillated during the polishing process, the target object tends to become displaced or jump out such that not only does it become impossible to polish the target object with a high level of flatness but the oscillation may also cause the target object to be damaged or destroyed. Even if the target object is not damaged, uniformity of the surface condition of the target object becomes worse as a whole if the width of oscillations of the groove pattern is made too large. It also becomes necessary to increase the radius of the platen by the width of the oscillation, and this has the demerit of causing the footprints of the device to become larger.

It is therefore an object of this invention to provide a polishing method, capable of polishing the surface of a target object by using a polishing pad having a groove pattern formed thereon and without oscillating the polishing head or the platen.

A polishing pad having a circular shape according to this invention with which the objects described above can be accomplished may be characterized as having a surface, grooves being formed on this surface in a spiral pattern having a center point offset from the center of the circular shape. Thus, the grooves will move in the direction of the radius of the platen on the surface of the target object during the polishing process.

In the above, the spiral pattern is preferably an Archimedean spiral pattern or a parabolic spiral pattern, and the offset has a distance less than the radius of the circular shape. The polishing pad may have second grooves in a lattice pattern on the surface, and the surface may have holes formed in a dotted pattern. The polishing pad may preferably comprise a uniform, solid planar material made of a synthetic resin.

A method according to this invention of polishing a target surface of a target object may be characterized as comprising the steps of rotating a circular platen having a polishing pad pasted thereonto around a center of rotation, supplying a polishing liquid onto a polishing surface of the polishing pad and pressing the target surface of the target object against the polishing surface of the polishing pad. In this method, the breadth of the target surface is less than the radius of the platen, grooves are formed on the polishing surface of the polishing pad in a spiral pattern, and the center of the spiral pattern is offset from the center of rotation.

According to this method, the target object is pressed onto the polishing surface of the polishing pad at a fixed position with respect to the center of rotation of the platen. Thus, the target object does not undergo any reciprocating motion in the radial direction of the platen during the polishing process, while the grooves on the polishing pad move on the target surface of the target object in the radial direction of the platen.

In summary, the waviness on the target surface of the target object can be reduced.

BRIEF DESCRIPTION OF THE DRAWINGS

FIG. 8 shows the measured results of surface uniformity and waviness.

DETAILED DESCRIPTION OF THE INVENTION

Figure 2A:
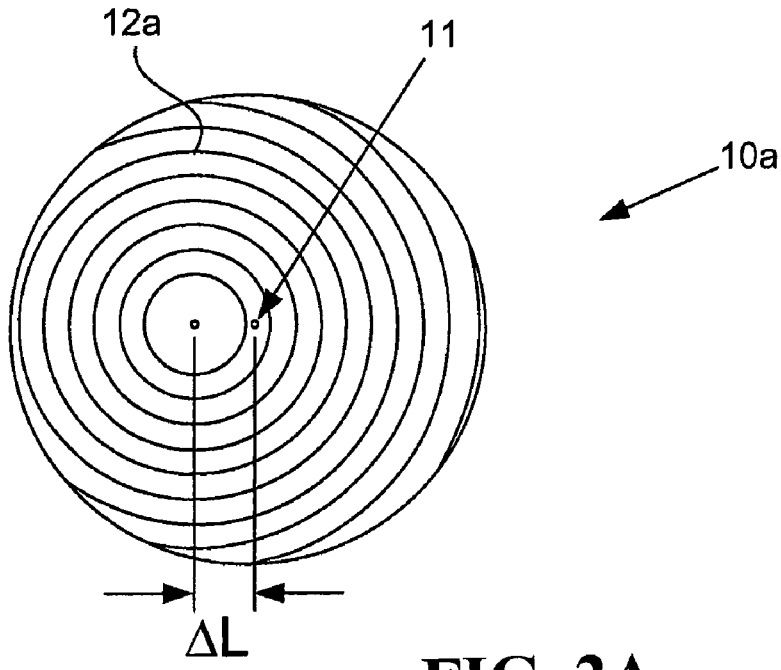
FIGS. 2A and 2B are each a plan view of a polishing pad according to this invention.
Figure 2B:
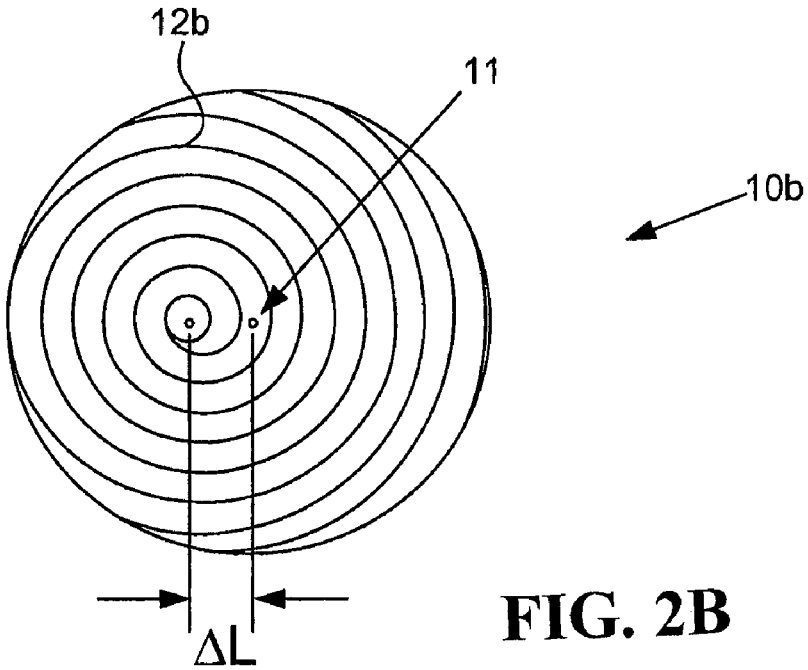

FIGS. 2A and 2B are each a plan view of a polishing pad according to this invention. FIG. 2A shows a circular polishing pad 10*a* having grooves 12*a* in a pattern with concentric circles, and FIG. 2B shows another circular polishing pad 10*b* having grooves 12*b* in a spiral pattern. The points of origin (the center points) of these patterns are offset from the center 11 of each circular pad, the distance of the offset being indicated as $\Delta L$.

The invention does not impose any particular limitation on the size of the polishing pad 10*b*. It may be of the size of any of ordinary polishing pads, that is, the radius may be within the range between 10 inches (25.4 cm) and 16 inches (40.6 cm), and the thickness may be within the range of 0.5 mm and 3.5 mm.

Neither does the invention impose any particular limitation on the size or the pitch of the grooves 12*b* or 12*a* formed on the surface of the polishing pad 10*b*. In other words, the polishing pad 10*b* of this invention may have the size and the pitch of ordinary grooves, the size being in the range between 0.2 mm and 2.0 mm, the depth being in the range between 0.3 mm and 0.8 mm, and the pitch being in the range between 0.3 mm and 10 mm.

In the planarization of the surface of a semiconductor device wafer, the width of the grooves 12*b* is in the range between 0.3 mm and 0.8 mm, the depth is in the range between 0.3 mm and 0.8 mm, and the pitch is in the range between 0.6 mm and 3.2 mm.

The distance of the aforementioned offset ΔL is less than the distance of the radius of the circular polishing pad 10*b*.

In the planarization of the surface of a semiconductor device wafer, the distance of offset ΔL is preferably in the range of between 5 mm and 30 mm, and more preferably in the range of between 5 mm and 15 mm.

Figure 3A:
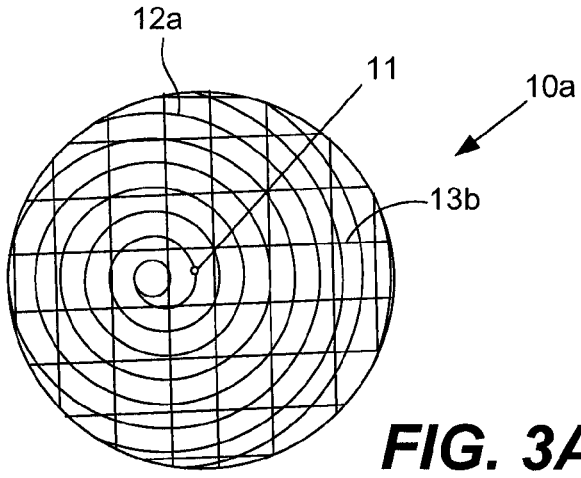
FIG. 3A shows grooves in a lattice-shaped pattern additionally formed on the surface of a polishing pad according to this invention.
Figure 3B:
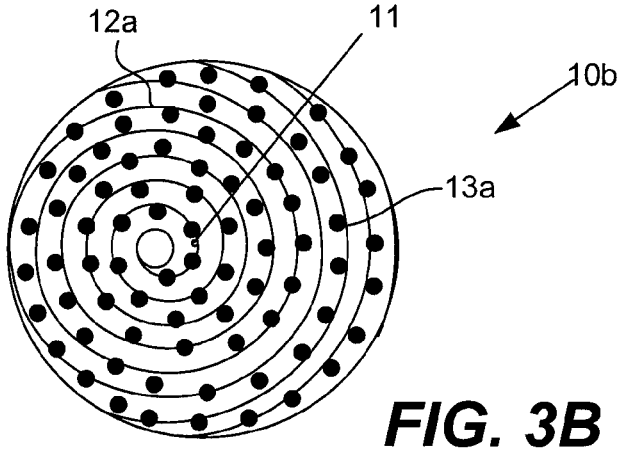
FIG. 3B shows dot-like holes that are formed additionally on the surface of a polishing pad according to this invention.
Figure 4:
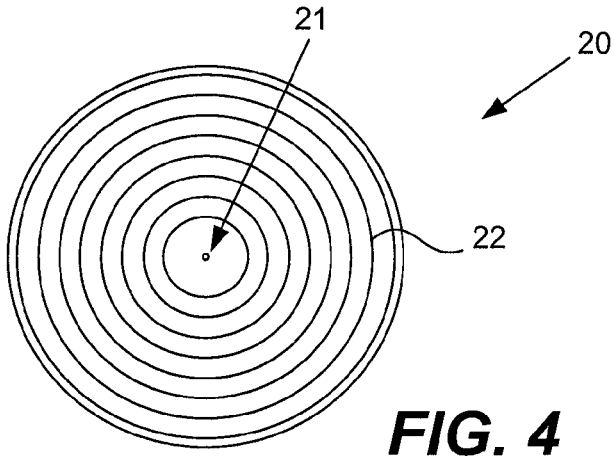
FIG. 4 (PRIOR ART)
FIG. 4 is a plan view of a conventional polishing pad.

Circular polishing pads of this invention may additionally have grooves in a lattice pattern as shown at 13*b* in FIG. 3A and/or holes in a dotted pattern as shown at 13*a* in FIG. 3B on the surface.

The spiral groove 12*b* of this invention may preferably be an Archimedean spiral or a parabolic spiral having its origin (center point) displaced from the center 11 of the circular polishing pad 10 by a distance shown by ΔL. In the above, the Archimedean spiral is expressed in polar coordinates as $r=a\theta$, the successive turnings of the spiral having a constant separation distance, while the parabolic spiral is expressed in polar coordinates as $r=a\theta^{1/2}$, the successive turnings of the spiral having smaller separation distances as r increases.

The circular polishing pad 10*b* of this invention may be used both for the rough polishing or mirror polishing of the surface of a target object. In other words, the polishing pad 10*b* of this invention includes both those comprising a foamed or non-foamed pad having abrading particles dispersed and fixed therein and the aforementioned pattern formed on the surface and those comprising a foamed or non-foamed pad not having abrading particles dispersed and fixed therein and the aforementioned pattern formed on the surface. In the above, the non-foamed pad means a pad comprising a uniformly solid planar material made of a synthetic resin.

For the planarization of the surface of a semiconductor device wafer, it is preferable to use a polishing pad comprising a non-foamed pad of a uniformly solid planar material with compressibility less than 2%, made of a resin, having grooves 12*b* formed on the surface with the aforementioned pattern. This is because a polishing pad comprising a foamed pad cannot have its surface uniformly pressed against the entire surface of the semiconductor device wafer since the size and density of air holes dispersed inside the polishing pad vary locally. Moreover, the compressibility of foamed pads is high because air holes are dispersed throughout and hence the wafer tends to become pushed inside the polishing pad such that it becomes difficult to uniformly planarize the wafer from its center portion to its edge portion.

A polishing pad according to this invention for fixed particle polishing may be produced by molding a block of foamed or non-formed material having abrading particles dispersed and fixed, obtaining a foamed or non-foamed planar material by slicing or cutting to a specified thickness, forming grooves 12*b* in a spiral pattern on its surface, say, by using a lathe, and punching a circular portion with a specified radius out of this planar material with the center at a position offset from the starting point (origin) of this spiral pattern. Abrading particles of known kinds such as aluminum oxide, cerium oxide and diamond may be used. The block of the foamed or non-foamed material has abrading particles fixed with polyurethane resin.

A polishing pad according to this invention for free particle polishing may be produced by molding a block of foamed or non-foamed material not having abrading particles fixed, obtaining a foamed or non-foamed planar material by slicing or cutting to a specified thickness, forming grooves 12*b* in a spiral pattern on its surface, say, by using a lathe, and punching a circular portion with a specified radius out of this planar material with the center at a position offset from the starting point (origin) of this spiral pattern.

A polishing pad appropriate for the planarization of the surface of a semiconductor device wafer may be produced by molding a (uniformly solid) block of a non-foamed material (made of a synthetic resin), obtaining a foamed or non-foamed planar material by slicing or cutting to a specified thickness, forming grooves 12*b* in a spiral pattern on its surface, say, by using a lathe, and punching a circular portion with a specified radius out of this planar material with the center at a position offset from the starting point (origin) of this spiral pattern.

In the above, the block of the non-foamed material may be produced by filling a mold with a liquid mixture of polyurethane, polyethylene, polystyrene, polyvinyl chloride or acryl resin and a hardening agent and causing this mixture to harden.

The optical transmissivity of the polishing pad can be improved by using a synthetic resin with high purity. Polishing pads with improved optical transmissivity are useful for the final polishing of target objects such as semiconductor device wafers. The higher the optical transmissivity, the more accurately the judgment can be carried out at the time of ending the polishing.

Synthetic resin materials of purity 60% or more and preferably 90% or more are used for such purposes. As synthetic polyurethane resin material, for example, trilene diisocyanate with purity 60% or more, methaxylilene diisocyanate and hexamethylene diisocyanate with purity 90% or more may be used.

Examples of hardening agent that may be used include 3,3'-dichloro-4,4'-diamino diphenyl methane (such as MOCA (tradename) produced by Dupont), compound of methylene dianine and sodium chloride (such as Caytur 21 (tradename) produced by Dupont), and mixture of dimethyl thio 2,4-toluene diamine and dimethyl thio 2,6-toluene diamine (such as Ethacure 300 (tradename) produced by Albemarle Corporation).

Figure 1A:
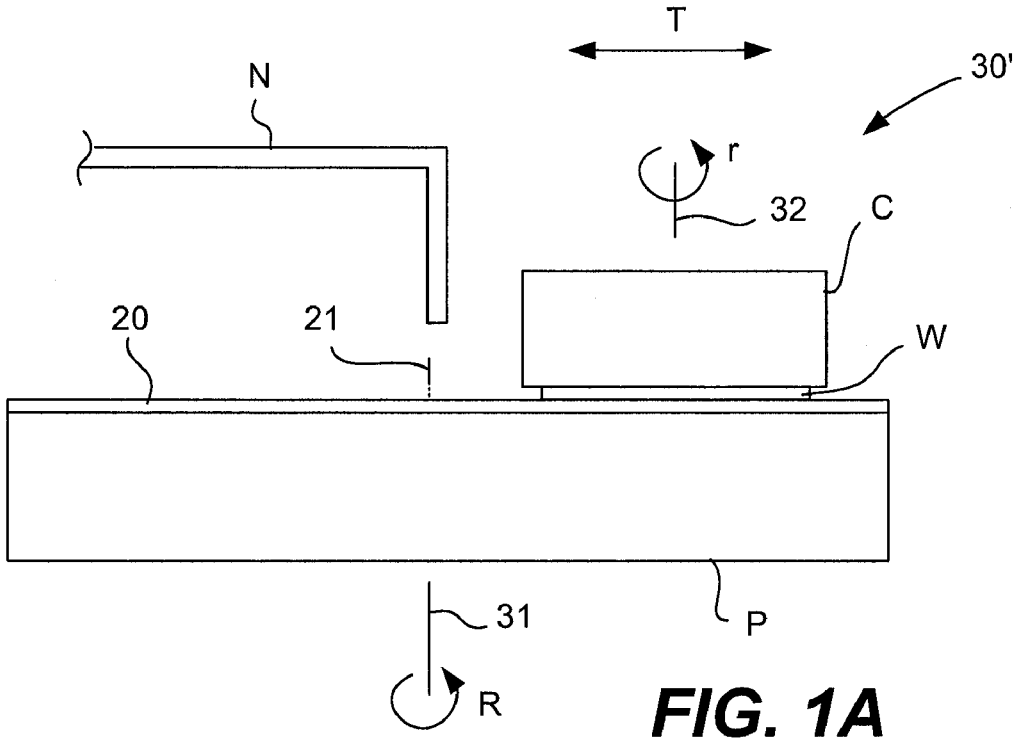
FIG. 1A (PRIOR ART)
FIG. 1A shows a conventional polishing device of the oscillating polishing head type.
Figure 1B:
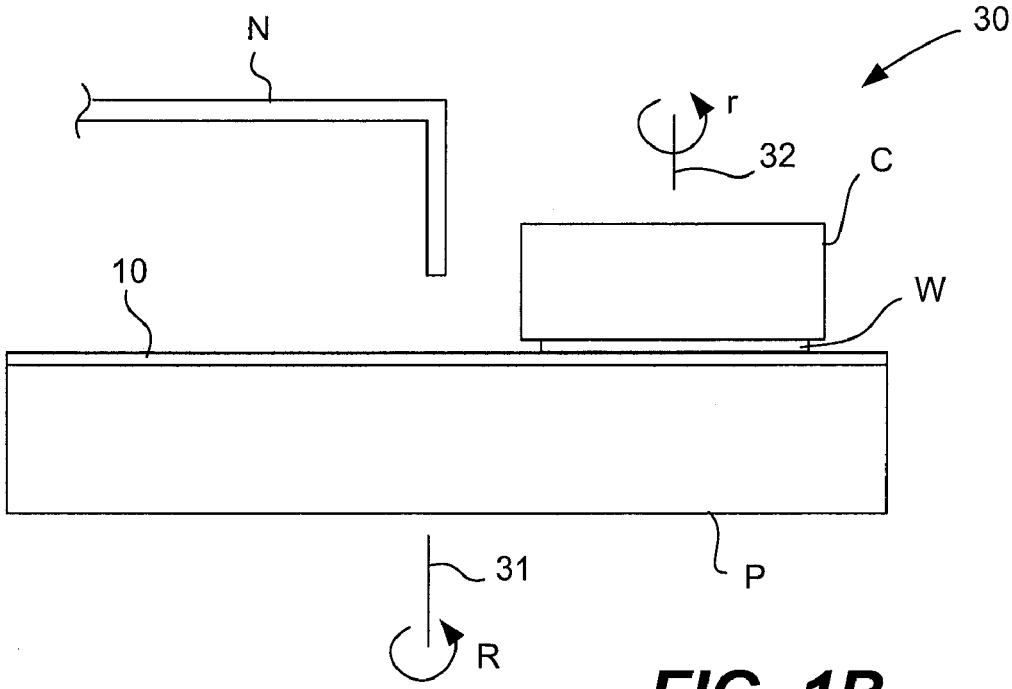
FIG. 1B shows a polishing device according to the present invention.

The surface of a target object such as a semiconductor device wafer can be polished by using a polishing device shown at 30 in FIG. 1B, which is similar to the prior art polishing device 30' shown in FIG. 1A except the polishing head C is not adapted to oscillate in the radial direction of the platen P (the mechanism for this oscillation being absent).

Explained more in detail, the polishing device 30 of FIG. 1B comprises a platen P with a flat circular surface, a polishing head C for holding a semiconductor device wafer (hereinafter referred to simply as the wafer) W and pressing the surface of this wafer W against the surface of the circular polishing pad 10 described above pasted onto the surface of the platen P, and a nozzle N for supplying a polishing liquid to the surface of this polishing pad 10 pasted onto the surface of the platen P. This polishing pad 10 is pasted onto the surface of the platen P such that its center point 11 is at the center of rotation 31 of the platen P.

The platen P is rotated in the direction of arrow R around the center of rotation 31 at the center of the circular platen P by a driving mechanism (not shown) connected to the platen P. The wafer W is held by the polishing head C inside a retainer ring such that its center will coincide with the center of rotation 32 of the polishing head C and is rotated in the direction of arrow r around its center, or the center of rotation 32 of the polishing head C, by a driving mechanism (not shown) connected to the polishing head C.

In order to make uniform the relative speed of the wafer W being pressed by the polishing pad 10 (with respect to the polishing pad) within its surface, the platen P and the wafer W are rotated in the same direction (in the directions of arrows R and r).

According to this invention, the surface of the target object W is polished as the platen P with the polishing pad 10*b* of this invention pasted on its surface is rotated in the direction of arrow R, a polishing liquid is supplied to the surface of this polishing pad 10*b* through the nozzle N and the surface of the target object W is pressed onto the surface of this polishing pad 10*b*. According to this invention, the target object W and the platen P are rotated in the same direction (in the directions of arrows R and r).

The width of the surface of the target object W is less than the length of the radius of the polishing pad 10*b*. Thus, the surface of the target object W does not come to the position of the center point 11 of the polishing pad 10*b* during the polishing process.

The position of the target object W pressed onto the surface of the polishing pad 10 of this invention pasted to the surface of the platen P is fixed with respect to the center point 11 of this circular polishing pad 10. As a result, the target object W does not move during the polishing in the direction along the radius of the polishing pad 10. In the meantime, however, the grooves 12*b* having the pattern as described above with its center point offset from the center point 11 of the polishing pad 10 do move in the radial direction by the distance of offset ΔL. This distance of offset is preferably so as not to reach the outer periphery of the circular target object W. In other words, the distance of ΔL is preferably 5 mm or more and within the outer periphery of the target object W and less than the shortest distance from the center of rotation of the platen P to the target object W being pressed onto the surface of the polishing pad 10*b*.

Examples of the slurry that is supplied to the surface of the polishing pad 10 during the polishing include slurry having abrading particles dispersed inside a liquid, cooling and lubricating liquids not containing abrading particles, liquids containing a chemical agent that reacts chemically with the surface of the target object and slurry having abrading particles dispersed in such a chemical agent.

Use may also be made of a polishing liquid containing abrading particles, and examples of such polishing liquid include slurry having abrading particles dispersed in a liquid, and those obtained by adding to such slurry a chemical agent that reacts chemically with the surface of the target object.

Examples of such chemical agent include potassium hydroxide, tetramethyl ammonium hydroxide, fluoric acid and fluorides, if the material comprising the surface of the target object W is silicon dioxide. If the surface of the target object W comprises tungsten, iron nitrate and potassium iodate may be added. If the surface of the target object W is copper, glycine, quinaldinic acid, hydrogen peroxide and benzotriazol may be added.

For the planarization of the surface of a semiconductor device wafer, a non-foamed pad not having abrading particles fixed is used, as explained above, together with slurry having abrading particles dispersed in a liquid such as water, water with a dispersant such as alcohols and glycols or a chemical agent that reacts chemically with the surface of the wafer. Examples of abrading particles to be contained in the polishing liquid include hard particles of colloidal silica, fumed silica, aluminum oxide, cerium oxide and diamond with average diameter in the range between 10 nm and 1 μm.

Test Example

Polishing pads having grooves in a pattern with concentric circles with the center point offset from the center of the pad and polishing pads having grooves in a spiral pattern were produced.

Production of Polishing Pads

A mold was filled with a mixed liquid of 100 parts of urethane prepolymer (methaxylilene diisocyanate with purity 90% or more) heated to 80° C. and 30 parts of a hardener heated to 120° C. (MOCA (tradename) produced by Dupont), and this mixture was maintained at 120° C. for 10 minutes to form a block of a non-foamed material. This block was taken out of the mold and after it was maintained inside a thermostatic container at 100° C. for 12 hours, it was naturally cooled.

This block was cut to obtain planar non-foamed materials with thickness 1.5 mm.

Next, a lathe of a know kind was used to form grooves in concentric circles on the surface of this planar material. Spiral grooves were formed on the surface of another planar material. The widths and pitches of these grooves were as shown in Table 2 below.

Lastly, a circular shape with radius 12 inches (about 30.5 cm) was punched out of the material with the grooves in the concentric circles with its center at a position displaced from the center of the concentric circles by a distance of 15 mm to obtain a polishing pad. In addition, another polishing pad was also produced of the same size but without the offset as Comparison Example.

Similarly, circular shapes each with radius 12 inches (about 30.5 cm) were punched out of the material with the grooves in the spiral pattern with its center at a position displaced from the center of the concentric circles by a distance respectively of 0 mm, 5 mm, 15 mm, 30 mm and 35 mm to obtain polishing pads of Test Examples. These polishing pads are each affixed to the platen P through a cushion layer and an adhesive layer (1.1 mm) such that the total thickness of the polishing pads becomes 2.6 mm.

The optical transmissivity of the aforementioned planar non-foamed material with thickness 1.5 mm was measured. It was 10% or more for light with wavelength 370 nm or more and 30% or more for light with wavelength 400 nm or more. These measurements were made by using a commercially available spectrophotometer (DR/2010 (tradename) produced by Central Kagaku, Ltd.) under the conditions shown in Table 1 below.

TABLE 1

| | |
|---|---|
| Resolution | 1 nm |
| Light source | Halogen lamp |
| Light receiving element | Silicon photodiode |
| Range of wavelength | 350 nm-900 nm |

Characteristics of the polishing pads produced are shown in Table 2 below.

TABLE 2

| | Groove pattern of produced polishing pads | |
|---|---|---|
| | Spiral pattern | Concentric circles |
| Radius | 12 inches | 12 inches |
| Total thickness | 2.6 mm | 2.6 mm |
| Surface layer | 1.5 mm | 1.5 mm |
| Cushion layer + adhesive layer | 1.1 mm | 1.1 mm |

TABLE 2-continued

| | Groove pattern of produced polishing pads | |
|---|---|---|
| | Spiral pattern | Concentric circles |
| Breath of groove | 0.3 mm | 0.3 mm |
| Depth of groove | 0.45 mm | 0.45 mm |
| Pitch of groove | 0.9 mm | 0.9 mm |
| Offset distance | Example 1: 0 mm<br>Example 2: 5 mm<br>Example 3: 15 mm<br>Example 4: 30 mm<br>Example 5: 35 mm | Example 6: 0 mm<br>Example 7: 15 mm |

The polishing pads of Examples 1-7 shown above were used to polish the surface of semiconductor device wafers (size: 8 inches (200 mm)) under the conditions shown in Table 3 below. The polishing device shown in FIG. 1B was used for Test Examples and the device shown in FIG. 1A was used for Comparison Examples.

Used as polishing liquid was colloidal silica slurry containing abrading particles with average diameter of 140 nm (SS-25 (tradename) produced by Cabot Corporation) diluted by a factor of 2 (particle density of 12.5 wt %).

TABLE 3

| | |
|---|---|
| Rotational speed of platen | 80 rpm |
| Rotational speed of polishing head | 81 rpm |
| Applied pressure | 3.0 psi |
| Oscillation | None |
| Time of polishing | 90 seconds |

On the surfaces of the semiconductor device wafers after the polishing, uniformity over the surface and the waviness were measured. Details of these measurements are shown in Tables 4 and 5.

TABLE 4

| | |
|---|---|
| Polishing device | NanoSpece9200 by Nanometrics Corporation |
| Method of measurement | White light interference method |
| Target object of measurement | Oxide film |
| Wafer size | 8" (200 mm) |
| Position of measurement | Polar map type with 49 points |
| Edge cut | 5 mm |

TABLE 5

| | |
|---|---|
| Polishing device | NanoSpece9200 by Nanometrics Corporation |
| Method of measurement | White light interference method |
| Target object of measurement | Oxide film |
| Wafer size | 8" (200 mm) |
| Position of measurement | To left and right by 10 mm from center of wafer with pitch of 0.1 mm |

Figure 5A:
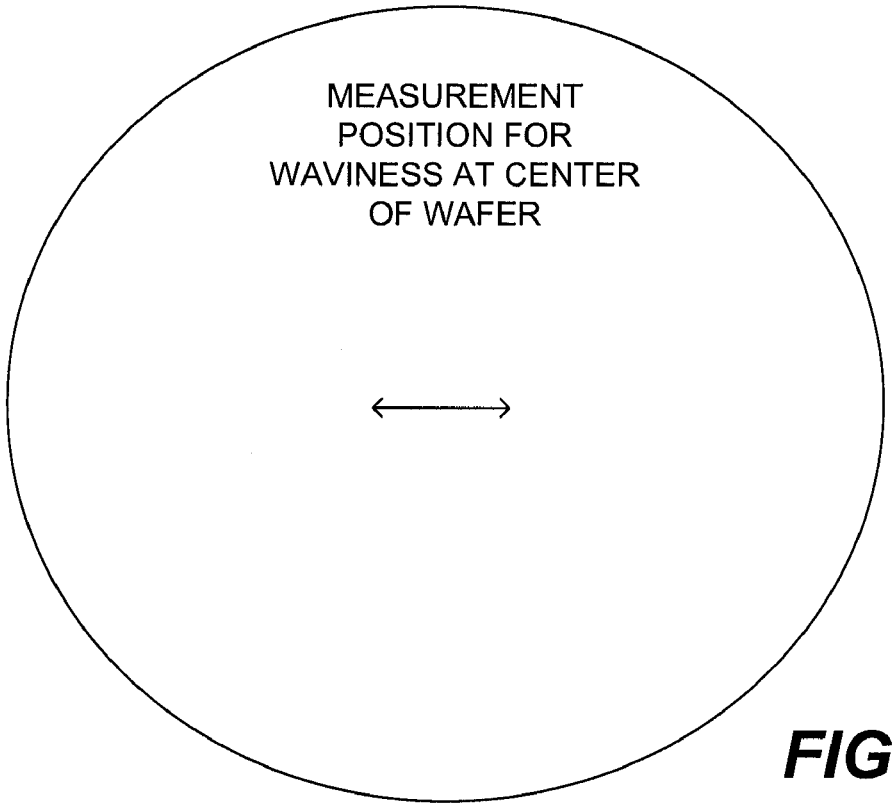
FIG. 5A shows the position where the uniformity of the semiconductor wafer as a whole.
Figure 5B:
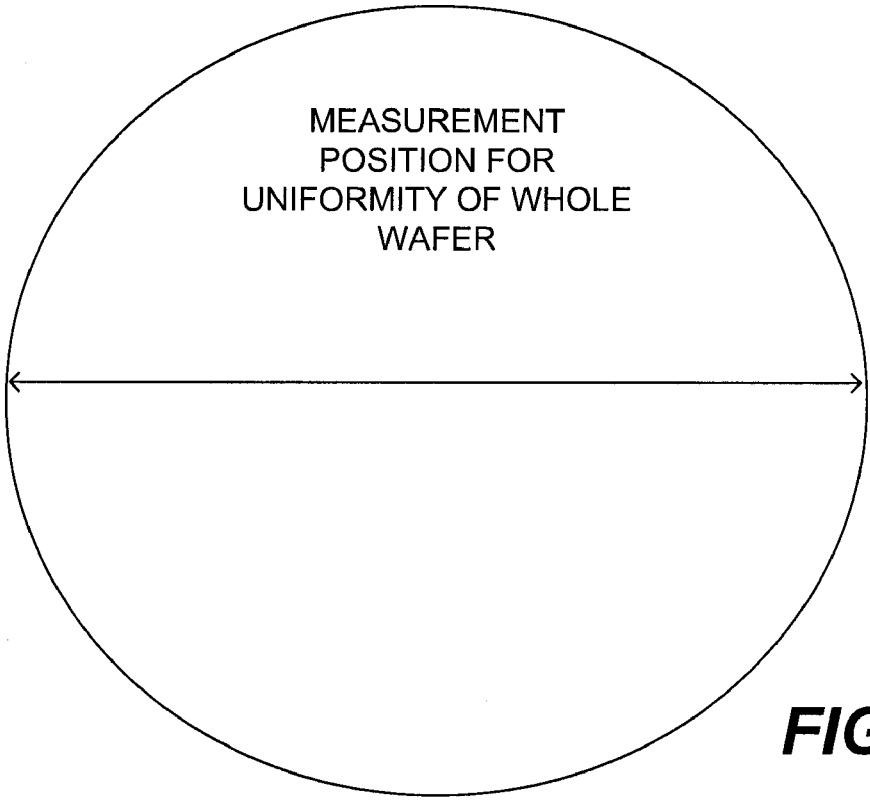
FIG. 5B shows position for measuring the waviness at the center portions of the semiconductor wafers.

FIG. 5 shows the positions of measurements, FIG. 5A showing the position where the uniformity of the semiconductor wafer as a whole and FIG. 5B showing the position for measuring the waviness at the center portions of the semiconductor wafers.

Figure 6:
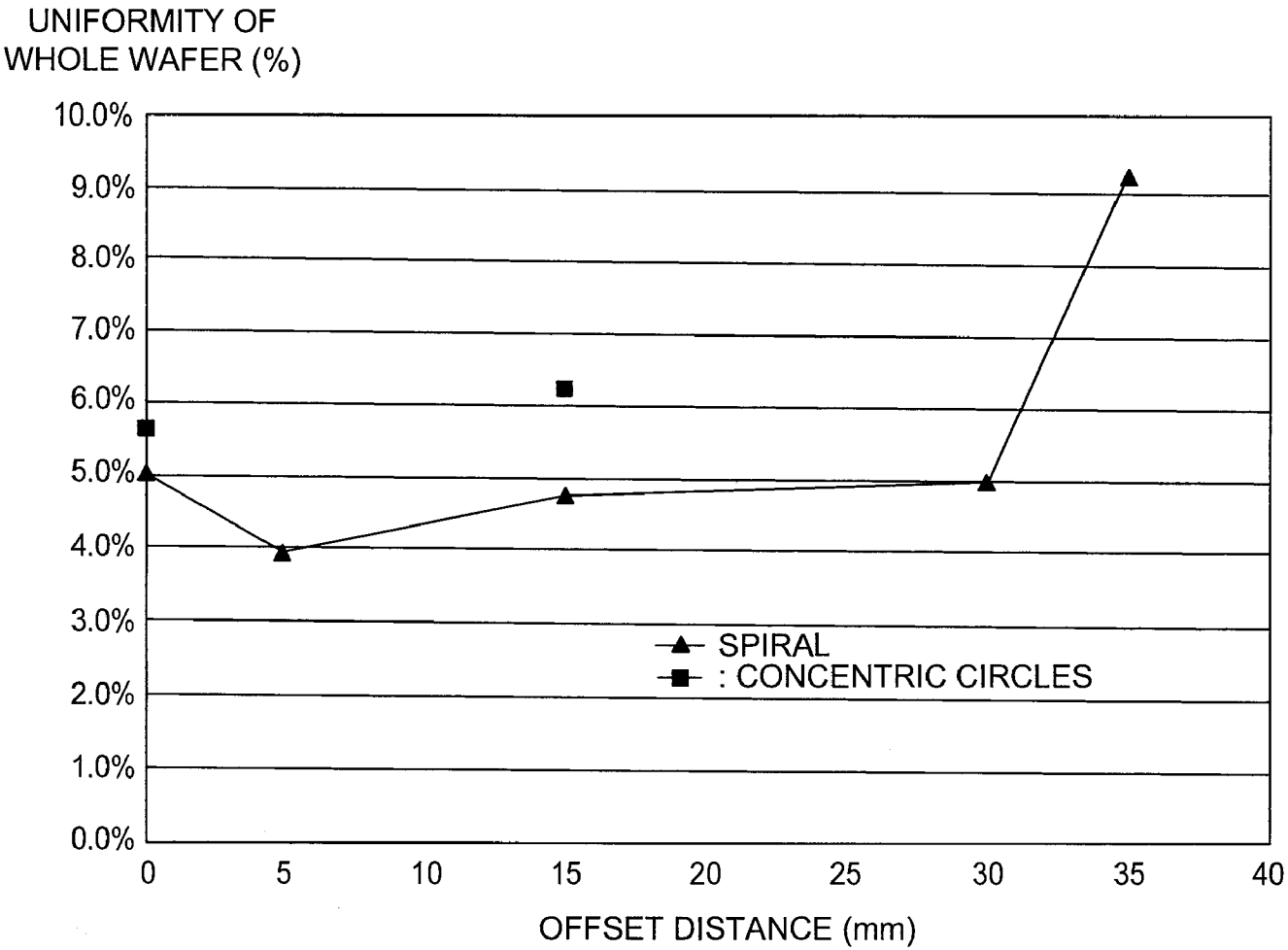
FIG. 6 is a graph of measured values showing the uniformity of the semiconductor wafer as a whole.

FIG. 6 is a graph of measured values showing the uniformity of the semiconductor wafer as a whole, and its results are shown in FIG. 8 ("A" indicating 7.0% or less and "C" indicating greater than 7.0%). As can be understood from this figure, the uniformity characteristics are good on both those polished by a polishing pad with grooves in concentric circles (Examples 6 and 7) and those polished by a polishing pad with spiral grooves (Examples 1-4). In other words, good results regarding uniformity can be obtained by both kinds of polishing pad with concentric circles and spiral grooves, independent of the offset. Among those polished by a polishing pad with spiral grooves, however, no improvement in uniformity is seen if the offset becomes 35 mm.

Figure 7:
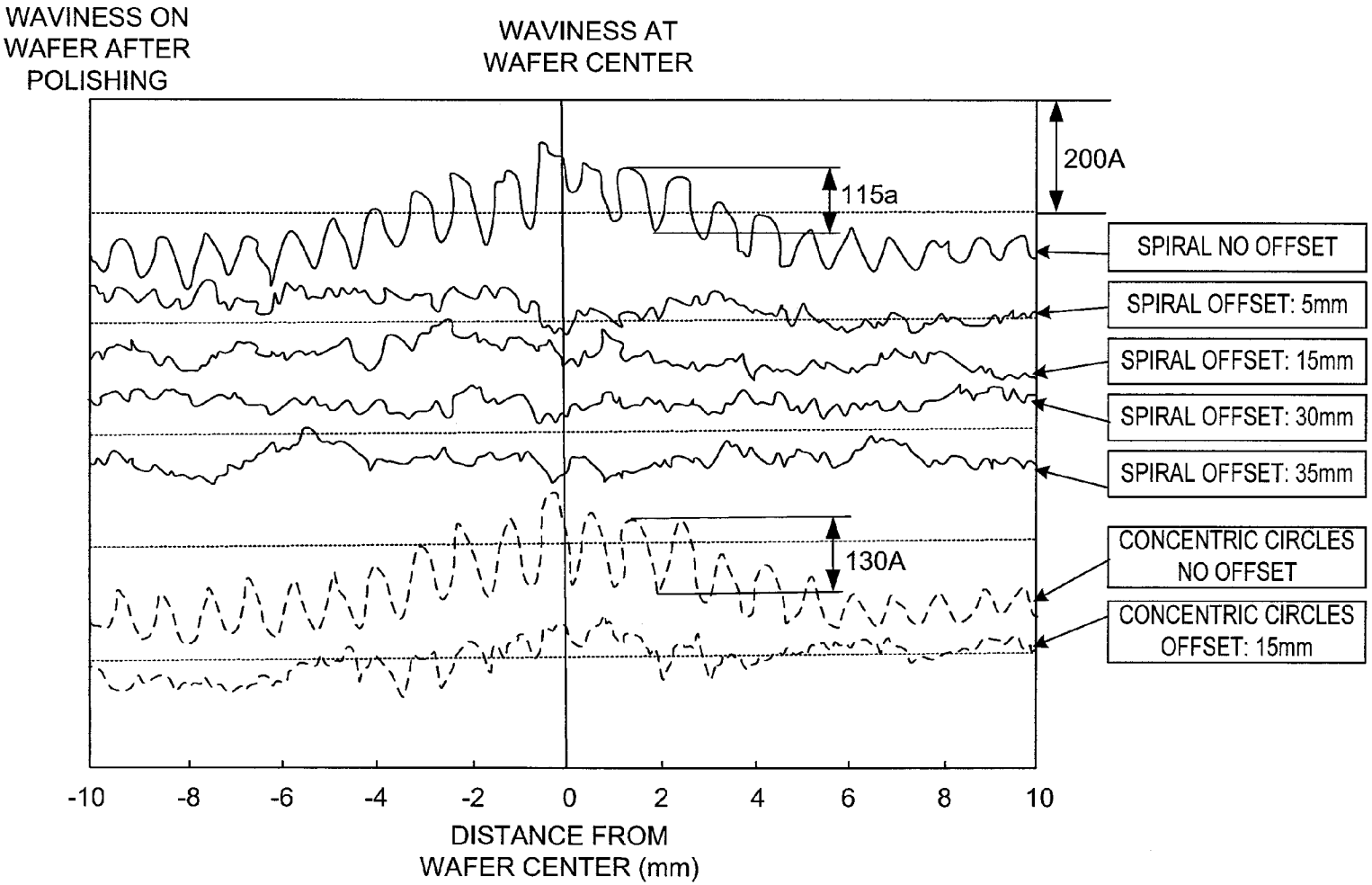
FIG. 7 is a graph of measured waviness.

FIG. 7 shows measured waviness, and FIG. 8 shows the measured results ("A" indicating 50 Å or less, "B" indicating greater than 50 Å and 100 Å or less, and "C" indicating greater than 100 Å). As can be seen, the waviness becomes about 100 Å and the results are very good with a polishing pad having offset spiral grooves but the results are worse with polishing pads having concentrically circular grooves than with those having spiral grooves.

In summary, good results regarding uniformity can be obtained by both kinds of polishing pad if the offset is less than 35 mm, or less than the shortest distance from the center of rotation of the platen to the target object W being pressed against the surface of the polishing pad, although better uniformity is possible with a polishing pad having spiral grooves. As for waviness, no improvement is observed either by a polishing pad having concentrically circular grooves or by a polishing pad having spiral grooves unless there is an offset. If the offset is 5 mm or more, a significant improvement is observed with a polishing pad having spiral grooves over the results obtainable by a polishing pad having concentrically circular grooves.

What is claimed is:

1. A method of polishing a target surface of a target object, said method comprising the steps of:

rotating a circular platen having a polishing pad pasted thereonto around a center of rotation;

supplying a polishing liquid onto a polishing surface of said polishing pad; and pressing said target surface of said target object against said polishing surface of said polishing pad;

wherein said target surface has a breadth less than the radius of said platen, grooves are formed on said polishing surface of said polishing pad in a spiral pattern, the center of said spiral pattern is offset from said center of rotation, and said center of rotation is inside said spiral pattern.

2. The method of claim 1 wherein said target object is pressed onto said polishing surface of said polishing pad at a fixed position with respect to said center of rotation of said platen.

3. The method of claim 1 wherein said target object is circular and is rotated in the same direction as said platen.

4. The method of claim 1 wherein said spiral pattern of said grooves is either an Archimedean spiral pattern or a parabolic spiral pattern.

5. The method of claim 1 wherein the center of said spiral pattern is offset from said center of rotation by a distance of 5 mm or more and said distance is shorter than the shortest distance between said center of rotation of said platen and said target object being pressed onto said polishing surface of said polishing pad.

6. The method of claim 1 wherein said polishing pad has second grooves in a lattice pattern.

7. The method of claim 1 wherein said surface has holes formed in a dotted pattern.

8. The method of claim 1 wherein said polishing pad comprises a uniform, solid planar material made of a synthetic resin.

* * * * *